US011852044B2

(12) United States Patent
Ari

(10) Patent No.: US 11,852,044 B2
(45) Date of Patent: Dec. 26, 2023

(54) POWER GENERATING MACHINE SYSTEM

(71) Applicant: Bayram Ari, Istanbul (TR)

(72) Inventor: Bayram Ari, Istanbul (TR)

( * ) Notice: Subject to any disclaimer, the term of this patent is extended or adjusted under 35 U.S.C. 154(b) by 95 days.

(21) Appl. No.: 17/633,592

(22) PCT Filed: Nov. 11, 2019

(86) PCT No.: PCT/TR2019/050938
§ 371 (c)(1),
(2) Date: Feb. 8, 2022

(87) PCT Pub. No.: WO2021/025639
PCT Pub. Date: Feb. 11, 2021

(65) Prior Publication Data

US 2022/0325636 A1 Oct. 13, 2022

(30) Foreign Application Priority Data

Aug. 8, 2019 (TR) ..... 2019/12112

(51) Int. Cl.
*F01K 7/40* (2006.01)

(52) U.S. Cl.
CPC ..... *F01K 7/40* (2013.01)

(58) Field of Classification Search
CPC ..... F28B 9/08; F28B 1/02; F28B 9/02; F01K 9/00; F05D 2220/60
See application file for complete search history.

(56) References Cited

U.S. PATENT DOCUMENTS

| | | | | |
|---|---|---|---|---|
| 3,724,212 | A * | 4/1973 | Bell | F01K 3/265 376/277 |
| 6,422,017 | B1 * | 7/2002 | Bassily | F01K 7/40 60/682 |
| 6,729,136 | B2 | 5/2004 | Dakhil | |
| 10,208,630 | B2 * | 2/2019 | Kirchner | F01K 9/00 |
| 2008/0034757 | A1 | 2/2008 | Skowronski et al. | |
| 2011/0131993 | A1 * | 6/2011 | Schule | F01K 3/265 60/645 |
| 2015/0027121 | A1 * | 1/2015 | Skowronski | F01K 23/103 60/645 |

FOREIGN PATENT DOCUMENTS

| | | | |
|---|---|---|---|
| CN | 201635781 | U | 11/2010 |
| CN | 107035447 | A | 8/2017 |
| GB | 787808 | A | 12/1957 |
| GB | 896194 | A * | 5/1962 |
| GB | 1214758 | A | 12/1970 |

* cited by examiner

*Primary Examiner* — Shafiq Mian
(74) *Attorney, Agent, or Firm* — Bayramoglu Law Offices LLC

(57) ABSTRACT

A power generating machine system is connected to the thermodynamic field similar to a steam power plant that can be used both mobile and in a fixed manner, which uses fluid liquid nitrogen and/or liquid air mixture and atmosphere air as an energy source. The power generating machine system is not harmful to the environment.

20 Claims, 1 Drawing Sheet

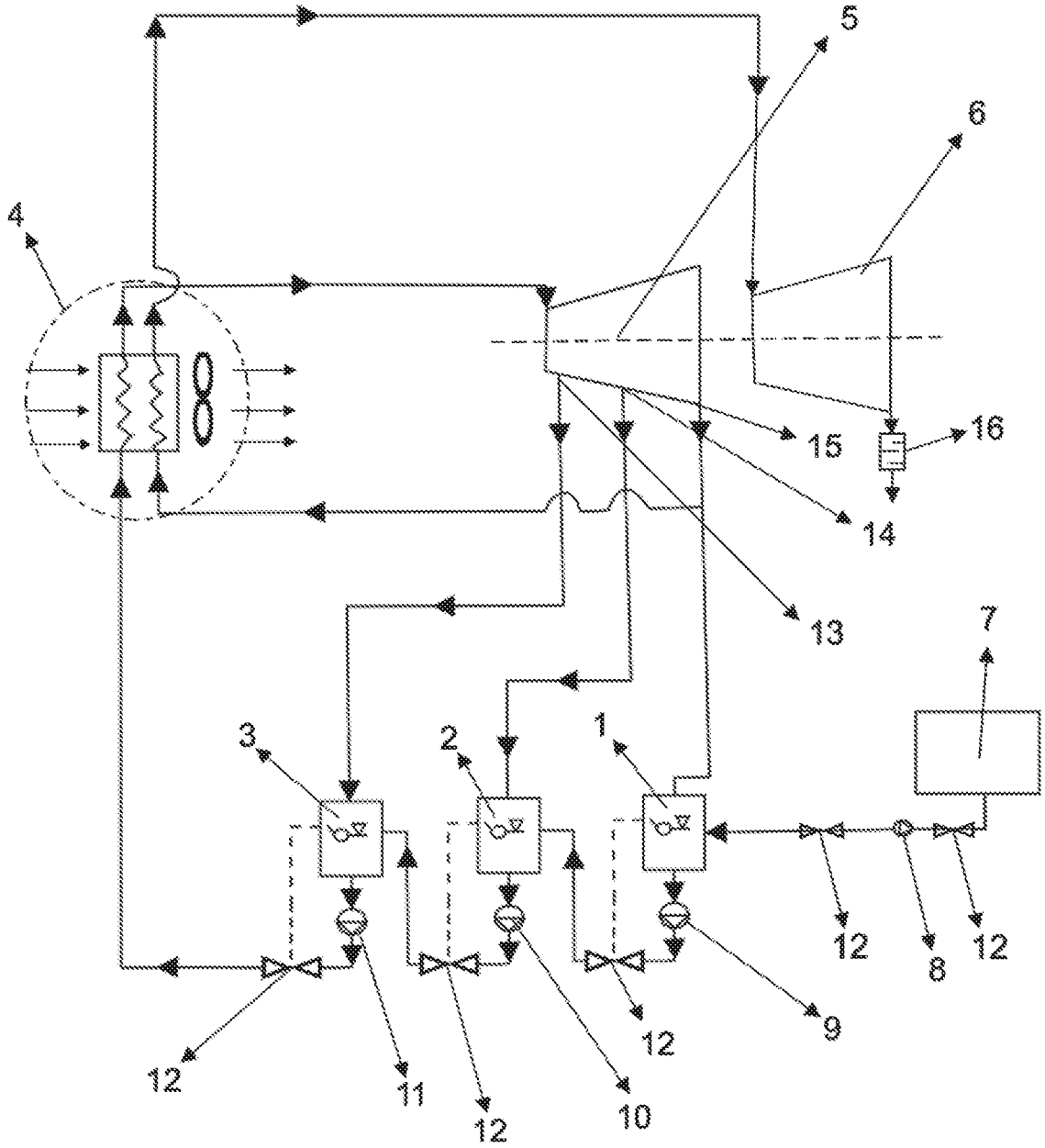
5
6
4
15
16
14
13
7
3
2
1
12
8
12
12
9
12
12
11
12
10

POWER GENERATING MACHINE SYSTEM

CROSS REFERENCE TO THE RELATED APPLICATIONS

This application is the national phase entry of International Application No. PCT/TR2019/050938, filed on Nov. 11, 2019, which is based upon and claims priority to Turkish Patent Application No. 2019/12112, filed on Aug. 8, 2019, the entire contents of which are incorporated herein by reference.

TECHNICAL FIELD

The invention is related to a power generating system connected to the thermodynamic field similar to a steam power plant that can be used both mobile and in a fixed manner, which uses fluid liquid nitrogen and/or liquid air mixture and atmosphere air as an energy source.

BACKGROUND

Water and water vapor is used in the steam power plants of the art. In steam power plants, additionally a boiler is present. In these boilers various fuels such as LPG, diesel oil, fuel oil, natural gas etc., are used. Some of these power plants operate according to the supercritical rankine cycle. In the steam power plants in such closed systems, liquid and steam is heated at a constant pressure and is then cooled. The fluid inside the pump is isoentropically compressed and the fluid inside the turbine can be isoentropically expanded. Differences in kinetic and potential energy are neglected and the heat transfer in a heat exchanger is carried out at a constant pressure. Continuous process conditions apply and heat loss in the heat exchanger, tanks, pipes and turbines are negligibly isolated. The properties of the fluid are kept constant, heat transfer in axial length is minimal and continuity equation is continuously provided.

In order to obtain the real cycle of steam engines, it is necessary to take into account the required difference in order to overcome frictional losses occurring at various points and heat losses and to provide heat transfer in the heaters.

Due to isoentropical compression and expansion division processes that are a crucial part of the compression process and the expansion process in a turbine, differences occur in thermodynamic features.

Several developments have been carried out in relation to a power generating machine system.

In the patent document numbered GB1214758A of the prior art, overloaded steam generators with super charge apparatus comprising a compressor and a gas turbine is disclosed.

In the United States patent document numbered U.S. Pat. No. 6,729,136B2 of the prior art, an energy generating power plant for a utility device which is used to expand and contract a liquid metal similar to mercury in order to actuate alternatively a piston, a crank shaft and following this an actuator using liquid nitrogen and a heated transfer fluid is disclosed. By operating the piston to control the various solenoid valves and pumps, timing is provided by allowing the liquid nitrogen to flow into a jacket around a reservoir containing the liquid metal, thereby allowing the piston to cool during the return movement. When suitable, the heated transfer fluid, is pumped with different jacket housing in order to force the remaining nitrogen and thereby to heat the liquid metal and drive the piston by means of force impact.

The process is continued such that continuous power is provided to the utility device.

The patent document numbered GB787808A of the prior art, discloses a thermal power plant used to heat seawater and propel a marine tanker. The plant consists of a working environment in which a gaseous working environment flowing in a closed cycle is increased to a higher pressure in a compressor, and then said working environment is heated and following this said environment is discharged from the turbine which emits heat to the working environment that has been compressed inside a heat exchanger before being re-compressed.

In the Chinese patent document numbered CN107035447A of the prior art, compressed critical carbon dioxide energy, and a heat storage system and the operation method thereof is disclosed. The system is formed of a motor, a compressor, a low pressure super critical carbon dioxide storage tank, a cooler, a heat accumulator, a high temperature oil tank, a high pressure super critical carbon dioxide storage tank, a low temperature oil pump and low temperature heating oil.

However the present steam machines obtained as a result of the developments in the art leads to air pollution as they use fossil fuels. Due to this reason the power generating machine system subject to the invention has been required to be developed.

SUMMARY

The aim of this invention is to provide a power generating machine system which eliminates air pollution, where the exhaust discharges only atmospheric air and does not cause any pollution.

Another aim of the invention is to provide a power generating machine system which saves the world from greenhouse effect, reduces global warming, stops the glaciers from melting and enables to cool the earth and which obtains continuous energy from the atmosphere.

Another aim of the invention is to provide a power generating machine system which is not harmful to the environment as it uses air instead of fossil fuel.

Another aim of the invention is to provide a power generating machine system which eliminates the cancerous effects and toxicities caused by CO, $CO_2$ and $NO_x$, sulphur oxides, lead compounds, petrol and diesel steam, emitted out of the exhausts of petrol, diesel fuel and LPG engines.

BRIEF DESCRIPTION OF THE DRAWINGS

The power generating machine system provided to reach the aims of the invention has been illustrated in the attached FIGURES.

According to these figures;

FIGURE is the schematic view of the power generating machine system.

The parts in the figures have each been numbered and their references have been listed below.

17. Heater I
18. Heater II
19. Heater III
20. Heater IV
21. Turbine I
22. Turbine II
23. Housing
24. Pump I
25. Pump II
26. Pump II

27. Pump IV
28. Valve
29. Turbine opening I,
30. Turbine opening II,
31. Turbine opening III,
32. Exhaust opening

DETAILED DESCRIPTION OF THE EMBODIMENT

A force machine system comprising the parts of;
Heater I (1) located in the system,
Heater II (2) connected to the Heater I (1),
Heater III (3) connected to the Heater II (2),
Heater IV (4) connected to the Heater III (3),
Turbine I (5) connected to the Heater IV (4),
Heater (4) whose one end is connected to the Heater I (1) and the other end to the turbine I (5),
Reservoir (7) connected to the Heater I (1),
Pump I (8) located between the Heater I (1) and reservoir (7),
Pump II (9) located between the Heater I (1) and the heater II (2),
Pump II (10) located between the Heater I (2) and the heater III (3),
Pump IV (11) located between the Heater I (3) and the heater IV (4),
Valve (12) located between heater I (1), and heater II (2), heater II (2) and heater III (3) and heater III (3) and heater IV (4),
Turbine opening I (15) which enables connection between the turbine I (5) and heater I (1),
Turbine opening II (14) which enables connection between the turbine I (5) and heater II (2),
Turbine opening II (13) which enables connection between the turbine I (5) and the heater I (3),
Exhaust opening (16) located on the turbine II (6).

In the system subject to the invention the superheated steam from the heater IV (4) located inside the heater IV (4) heated by means of air, enters into the turbine I (5). The superheated steam expands and is operated isoentropically in the turbine I (5). The expanded superheated steam in the turbine I (5), is transferred to heater I (1), heater II (2) and heater III (3) respectively by means of the turbine opening I (13), turbine opening II (4) and turbine opening I (15).

If necessary, isoentropical expansion needs to be supported in the turbine I (6) and turbine I (5) located in the system subject to the invention. Following this steam is re-heated until ambient temperature is reached with the heater IV (4). The heated steam operates isoentropically and is discharged.

Liquid nitrogen or liquid air in the reservoir (7) at atmospheric pressure is drawn from the reservoir (7) with the aid of a pump I (8). Pump I (8) pumps the liquid obtained from the reservoir (7) up to a pressure of 8.925 bars. Liquid steam obtained from the pump I (8) is sprayed onto the heater I (1). Steam can be condensed up to $m^3$/kg depending on the amount of sprayed liquid.

The steam condensed in the heater I (1) is transferred to the heater II (2) via the pump II (9). The cool liquid pumped from the heater (1) is sprayed to the heater II (2). Due to the sprayed liquid, steam received from the turbine opening II (14) of the turbine I (5) is condensed depending on the amount of steam and the temperature of cool steam. The steam condensed in the heater I (1) is transferred to heater I (2) pressure via the pump II (9).

The cold liquid pumped from heater I (1) is sprayed to Heater II (2) and the cold liquid pumped from heater II (2) is sprayed to the heater (III). Steam received from the turbine opening I (13) is condensed depending on the amount of steam and the temperature of cool steam. The pump III (10) pumps the liquid obtained from heater II (2) and transfers it to heater III (3). The heater III (3) sprays the liquid received from pump III (10) to heater IV (4) and the liquid obtained from heater (III) is pumped to heater (IV). The pump III (10) pumps the liquid obtained from heater III (3) to heater IV (4). The heater IV (4), heats the liquid received from pump III (10) via a ventilator by using atmosphere air and the system is completed.

In order to obtain the real cycle of steam engines, it is necessary to take into account the required difference in order to overcome frictional losses occurring at various points and heat losses and to provide heat transfer in the heaters. This value is accepted as +5K in calculations. It has been accepted that heat flow to the environment from the pump and the turbines is accepted to be zero. Said losses have been accepted to be $\eta_{it}$=0.90 ve $\eta_{ip}$=0.80 when the pump and turbine indicated yields are taken into consideration.

According to a different embodiment of the invention, number of heaters can be changed according to turbine numbers and machine size located in the system.

Thermodynamic calculations relating to the Invention;

Thermodynamic features in 1 atmosphere of air: air=−25° C., m=28.9586 g/mol

| P (MPa) | 0.09129($MP_a$) | 0.101325($MP_a$) | 0.10245($MP_a$) |
|---|---|---|---|
| h (j/mol) | −3702.1/2198.3 | $h_s/h_b$ | −3,645.9/2221.2 |
| s (j/mol · K) | 85.624/163.09 | $s_s/s_b$ | 86.334/162.34 |
| v (mol/$dm^3$) | 30.357 | $v_s$ | 30.200 |
| T (K) | 78 | T | 79 |

$$\frac{0.101325-0.09129}{0.10245-0.09139}=\frac{hs+3{,}702.1}{-3{,}645.9+3{,}702.1}\longrightarrow h_s$$

$$=-3651.11\ \text{j/mol}$$

$$\sim=\frac{Ss-85.624}{86.334-85.624}\longrightarrow S_s$$

$$=86.268\ \text{j/mol.K}$$

$$\sim=\frac{Vs-30.357}{30.200-30.357}\longrightarrow V_s$$

$$=30.21455\ \text{mol/1}$$

$$\sim=\frac{T-78}{79-78}\longrightarrow T$$

$$=78.91\ \text{K}$$

$$\sim=\frac{hb-2198.3}{2221.2-2198.3}\longrightarrow h_b$$

$$=2{,}219.1\ \text{j/mol}$$

$$\sim=\frac{Sb-163.09}{162.34-163.09}\longrightarrow S_b$$

$$=162.41\ \text{j/mol}$$

$P_1$=10,0 $MP_a$, $h_1$=217.055$k_j/k_g$
$T_1$=248K, $s_1$=152.164j/mol·K→

| T | 240 | 248 | 250 |
|---|---|---|---|
| h | 5,985.3 | $h_1$ | 6,360.7 |
| s | 150.94 | $s_1$ | 152.47 |

$$\frac{248-240}{250-240}=\frac{h1-5{,}985.3}{6{,}360.7-5{,}985.3}\longrightarrow h_1$$
$$=6{,}285.62\ \text{j/mol}$$
$$\sim=\frac{S1-150.94}{152.47-150.94}\longrightarrow S_1$$
$$=152.164\ \text{j/mol.K}$$

$P_2$=3.72284$MP_a$, $h_2$=158.983$k_j/k_g$
$S_2$=$S_1$=152.164j/mol·K
P=2.0 $MP_a$

| s | 151.50 | 152.169 | 152.69 |
|---|---|---|---|
| h | 3,822.5 | $h_{2.0}$ | 4004.9 |

$$\frac{152.164-151.50}{152.69-151.50}=\frac{h2.0-3{,}882.5}{4{,}004.9-3{,}882.5}\longrightarrow h_{2.0}=3{,}924.28\ \text{j/mol}$$

| s | 151.90 | 152.164 | 153.69 |
|---|---|---|---|
| h | 5,053.8 | $h_{5.0}$ | 5,419.6 |

$$\frac{152.164-151.90}{153.69-151.90}=\frac{h5.0-5{,}053.8}{5{,}419.6-5{,}053.8}\longrightarrow h_{5.0}=5{,}107.75\ \text{j/mol}$$

| P | 2.0 | 3.72284 | 5.0 |
|---|---|---|---|
| H | 3,924.28 | $h_2$ | 5,107.75 |

$$\frac{3{,}722.84-2.0}{5.0-2.0}=\frac{h2-3{,}924.28}{5{,}107.75-3{,}924.28}\longrightarrow h_2=4{,}603.92\ \text{j/mol}$$

$P_3$=2.87207 $MP_a$, $h_3$=147.393 $k_j/k_g$
$s_3$=$s_1$=152.164 j/mol·K
P=2.0 $MP_a$

| s | 151.50 | 152.164 | 152.69 |
|---|---|---|---|
| h | 3,882.5 | $h_{2.0}$ | 4,004.9 |

$$\frac{152.164-151.50}{152.69-151.50}=\frac{h2.0-3{,}882.5}{4{,}004.9-3{,}882.5}\longrightarrow h_{2.0}=3{,}924.285\ \text{j/mol}$$

P=5.0 MPa

| s | 151.90 | 152.164 | 153.69 |
|---|---|---|---|
| h | 5,053.8 | $h_{5.0}$ | 5,419.6 |

$$\frac{152.164-151.90}{153.69-151.90}=\frac{h5.0-5{,}053.8}{5{,}419.6-5{,}053.8}\longrightarrow h_{5.0}=5{,}107.75\ \text{j/mol}$$

| p | 2.0 | 2.87207 | 5.0 |
|---|---|---|---|
| h | 3,924.28 | $h_3$ | 5,107.75 |

$$\frac{2.87207-2.0}{5.0-2.0}=\frac{h3-3{,}924.28}{5{,}107.75-3{,}924.26}\longrightarrow h_3=4{,}268.30\ \text{j/mol}$$

$P_4$=1.04961 $MP_a$, $h_4$=112.559 $k_j/k_g$
$s_4$=$s_1$=152.164 j/mol·K

| s | 152.13 | 152.164 | 152.70 |
|---|---|---|---|
| h | 3,220.6 | $h_{1.0}$ | 3,292.1 |

$$\frac{152.164-152.13}{152.70-152.13}=\frac{h1.0-3{,}220.6}{3{,}292.1-3{,}220.6}\longrightarrow h_{1.0}=3{,}224.86\ \text{j/mol}$$

P=2.0 $MP_a$

| s | 151.50 | 152.164 | 152.69 |
|---|---|---|---|
| h | 3,822.5 | $h_{2.0}$ | 4,004.9 |

$$\frac{152.164-151.50}{152.69-151.50}=\frac{h2.0-3{,}822.5}{4{,}004.9-3{,}822.5}\longrightarrow h_{2.0}=3{,}924.285\ \text{j/mol}$$

| p | 1.0 | 1.04961 | 2.0 |
|---|---|---|---|
| h | 3,224.86 | $h_4$ | 3,924.28 |

$$\frac{1.04961-1.0}{2.0-1.0}=\frac{h4-3{,}224.86}{3{,}924.28-3{,}224.86}\longrightarrow h_4=3{,}259.55\ \text{j/mol}$$

$P_5$=1,04961 $MP_a$ $h_5$=244.873 $k_j/k_g$
$T_5$=248 K $s_5$=173.689 j/mol·K

| T | 240 | 248 | 250 |
|---|---|---|---|
| h | 6,857.4 | $h_{1.0}$ | 7,155.5 |
| s | 173.01 | $s_{1.0}$ | 174.23 |

$$\frac{248-240}{250-240}=\frac{h1.0-6{,}857.4}{7{,}155.5-6{,}857.4}\longrightarrow h_{1.0}=7{,}095.885\ \text{j/mol}$$

$$\sim=\frac{s1.0-173.01}{174.23-173.01}\longrightarrow s_{1.0}=173.99\ \text{j/mol}$$

P=2.0 $MP_a$

| T | 240 | 248 | 250 |
|---|---|---|---|
| h | 6,756.1 | $h_{2.0}$ | 7,062.2 |
| s | 166.92 | $s_{2.0}$ | 168.17 |

$$\frac{248-240}{250-240}=\frac{h2.0-6{,}756.1}{7{,}062.2-6{,}756.1}\longrightarrow h_{2.0}=7{,}000.98\ \text{j/mol}$$

$$\sim=\frac{s2.0-166.92}{168.17-166.92}\longrightarrow s_{2.0}=167.92\ \text{j/mol}$$

| p | 1.0 | 1.04961 | 2.0 |
|---|---|---|---|
| h | 7,095.88 | $h_{5.0}$ | 7,000.98 |
| s | 173.99 | $s_5$ | 167.92 |

$$\frac{1{,}496.1-1.0}{2.0-0.1}=\frac{h5-7{,}095.88}{7{,}000.98-7{,}095.88}\longrightarrow h_5=7{,}091.172\ \text{j/mol}$$

$$\sim=\frac{s5-173.99}{167.92-173.99}\longrightarrow s_5=173.689\ \text{j/mol}$$

$P_6$=0.101325$MP_a$ $h_6$=125.706$k_j/k_g$
$s_6$=$s_5$=173.689 j/mol·K $T_6$=126.8 K
$S_6=s_s=s_s+x(s_b-s_s)$
173,689=86.268+x(162,41−86,268)
173,689−86.268=76.142x
x=1.148 (at the superheated vapour region)

| s | 173.50 | 173.689 | 173.96 |
|---|---|---|---|
| h | 3,616.0 | $h_6$ | 3,675.1 |
| T | 126 | T6 | 128 |

$$\frac{173.689-173.50}{173.96-173.50}=\frac{h6-3{,}616.0}{3{,}6751-3{,}616.0}\longrightarrow h_6=3{,}640.28\ \text{j/mol}$$

$$\sim=\frac{T6-126}{128-126}\longrightarrow T_6=126.8\text{K}$$

$P_7$=0.101325 MPa
$v_7$=30.21455 mol/l→$v_7$=0.00114289 $m^3/k_g$
$h_7$=−3651.11 j/mol→$h_7$=−126.080 $k_j/k_g$
$-W_{Pa}=v_7(P_8-P_7)\rightarrow-W_{Pa}$=0.00114289 (1049.61−101.325)=1.084 $k_j/k_g$
$-W_{Pa}$=1.084 $k_j/k_g$
$-W_{Pa}-h_8-h_7\rightarrow1.084=h_8+126.080\rightarrow h_8=-124.996$ $k_j/k_g$
$P_9$=1.04961 $MP_a$ $v_9$=25.058 mol/l→$v_9$=0.00137809 $m^3/k_g$
$h_9$=−1,967.8 j/mol→$h_9$=−67,952 $k_j/k_g$
$-W_{Pb}=v_9(P_{10}-P_9)\rightarrow-W_{Pb}$=0.00137809(2872.07−1,049.6)
$-W_{Pb}$=2.511 $k_j/k_g$
$-W_{Pb}=h_{10}-h_9\rightarrow2.511=h_{10}+67.952\rightarrow h_{10}=-65.411$ $k_j/k_g$
$P_{11}$=2.87207 $MP_a$ $v_{11}$=19.278 mol/l→$v_{11}$=0.00179127 $m^3/k_g$
$h_{11}$=−475.47 j/mol→$h_{11}$=−16.419 $k_j/k_g$
$-W_{Pc}=v_{11}(P_{12}-P_{11})\rightarrow-W_{Pc}$=0.00179127(3722.84−2872.07)
$-W_{Pc}$=1.524 $k_j/k_g$
$-W_{Pc}=h_{12}-h_{11}\rightarrow1.524=h_{12}+16.419\rightarrow h_{12}=-14.899$ $k_j/k_g$
$P_{13}$=3.72284 $MP_a$ $v_{13}$=14.198 mol/l→$v_{13}$=0.00243218 $m^3/k_g$
$h_{13}$=478.83 j/mol→$h_{13}$=16.535 $k_j/k_g$
$-W_{Pd}=v_{13}(P_{14}-P_{13})\rightarrow-W_{Pd}$=0.00243218(10,000−3,722.84)
$-W_{Pd}$=15.267 $k_j/k_g$
$-W_{Pd}=h_{14}-h_{13}\rightarrow15.267=h_{14}-16.535\rightarrow h_{14}=31.802$ $k_j/k_g$
Calculations regarding Enthalpy points, pump works and condensed masses;

| |
|---|
| $h_1$ = 217.055 $k_j/k_g$ |
| $h_2$ = 158.983 $k_j/k_g$ |
| $h_3$ = 147.393 $k_j/k_g$ |
| $h_4$ = 112.559 $k_j/k_g$ |
| $h_5$ = 244.873 $k_j/k_g$ |
| $h_6$ = 125.706 $k_j/k_g$ |
| $h_7$ = 126.080 $k_j/k_g$ |
| $h_8$ = −124.996 $k_j/k_g$ |
| $h_9$ = −67.952 $k_j/k_g$ |
| $h_{10}$ = −65.441 $k_j/k_g$ |
| $h_{11}$ = −16.419 $k_j/k_g$ |
| $h_{12}$ = −14.895 $k_j/k_g$ |
| $h_{13}$ = 16.535 $k_j/k_g$ |
| $h_{14}$ = 31.802 $k_j/k_g$ |

$m_1$=0.180 $k_g$, $m_2$=0.189 $k_g$, $m_3$=0.152 $k_g$, m=0.520 $k_g$
$-W_{Pa}$=1.084 $k_j/k_g$, $W_{Pb}$=2.511 $k_j/k_g$, $-W_{Pc}$=1.524 $k_j/k_g$, $-W_{Pd}$=15.267 $k_j/k_g$
$m_1(h_2-h_{13})=(1-m_1)(h_{13}-h_{12})\rightarrow m_1(158.983-16.353)=(1-m_1)(16.553+14.895)$
$142.63m_1=31.43-31.43m_1\rightarrow142.63m_1+31.43m_1=31.43$
$m_1$=0.180 $k_g$
$m_2(h_3-h_{11})=(1-m_1-m_2)$
$m^2(147{,}393+16.419)=(1-0.180-m_2)(-16.419+65.441)$
$163.812m_2=40.198-49.022m_2\rightarrow m_2=0.189k_g$
$m_3(h_4-h_9)=(1-m_1-m_2-m_3)(h_9-h_8)$
$m_3(112.559+67.952)=(1-0.180-0.189-m_3)(-67.952+124.996)$
$180.511m_3=35.995-57.044m_3$
$180.511m_3+57.044m_4=35.995\rightarrow m_3=0.151k_g$
$m=m_1+m_2+m_3=0.180+0.188+0.0151=0.52k_g$
W=Specific job;
$W_T=h_1-h_2+(1-m_1)(h_2-h_3)+(1-m_1-m_2)(h_3-h_4)+(1-m)(h_5-h_6)$
$W_T$=217.055−158.983+(1−0.180)(158.983−147.393)+(1−0.180−0.189) . . . x(147.393−112.559)+(1−0.520)(244.873−125.706)=
$W_T$=58.072+9.504+21.980+57.200=146.756
$W_T$=146.756$k_j/k_g$
$W_{net}=W_T-(1-m)W_{Pa}-(1-m+m_3)W_{Pb}-(1-m+m_2+m_3)W_{Pc}-W_{Pd}$ $W_{net}$=146.756−(1−0.520)1.084−(1−0,520+0.152)2.511+(1−0.520+0.152+0.189) . . . x 1.524−15.267
$W_{net}$=146.756−0.520−1.758−1.251−15.267
$W_{net}$=128.131 $k_j/k_g$
Thermal Efficiency;
$q=h_1-h_{14}+(1-m)(h_5-h_4)$
q=217.055−31.802+(1−0.520)(244.873−112.559)
q=185.253+63.511=248,764 $k_j/k_g$, q=248.764 kj/kg
$\eta_{thermal}=W_{net}/q$=128.131/248.764=%51.51,
$\eta_{thermal}$=%51.51
Capacity of 1 $k_g$ fluid;
$k=W_{net}/(1-m)$=128.131/(1−0.520)=266.939kj/kg,
k=266.939kj/kg
Capacity for M=400 kg reservoir;

$$K = \frac{kM}{3600} = ((266.938)(400))/3600 = 29.660 \text{ kWh},$$

$$K = 29.660 \text{ kWh}$$

Irreversibility effect and Real Cycle;

In order to obtain the real cycle of steam engines, it is necessary to take into account the required difference in order to overcome frictional losses occurring at various points and heat losses and to provide heat transfer in the heaters.

Due to isoentropical compression and expansion division processes that are a crucial part of the compression process and the expansion process in a turbine, differences occur in thermodynamic features. It has been accepted that heat flow to the environment from the pump and the turbine is accepted to be zero. Said losses are as follows when pump and turbine indicated yields are taken into consideration;

Has been accepted as, $\eta_{it}$=0.90, $\eta_{ip}$=0.80
$W_{it}=W_T\cdot\eta_{it}$=146.756×0.90=132.080$k_j/k_g$, $W_{it}$=132.080$k_j/k_g$
$-W_{ip}=W_p/\eta_{ip}=(W_T-W_{net})/\eta_{ip}$=(146−756−128.131)/0.8
$-W_{ip}$=23.281 $k_j/k_g$
$W_{net,i}=W_{it}-W_{ip}$=132.080−23.281=108.799 $k_j/k_g$
$W_{net,i}$=108.799 $k_j/k_g$ $$\eta_{thermal} = \frac{w_{it} - w_{ip}}{h1 - h14 + (1-m)(h5 - h4)} \longrightarrow h_{14}$$
$$= h_{13} + \left((h_{14} - h_{13})/\eta_{ip}\right)$$
$$= 16.535 + ((31.802 - 16.535))/(0.8) \longrightarrow h_{14}$$
$$= 35.619 \text{ kj/kg}$$

$\eta_{thermal}$=(132.080−23.281)/((217.055−35.619)+(1−0.520)(244.873−112.559))
$\eta_{thermal}$=%44.42
Yield provided by 1 kg liquid air: $k=W_{net}/1-m$=108.799/1−0.52
k=226.664$k_j/k_g$
Capacity of M=400 kg reservoir
K=k·M/3600=((226.664×400))/3600→K=25.185 kWh
Thermodynamic calculations relating to the Invention;
Thermodynamic features of air in the atmosphere: air=+35° C., m=28.9586 g/mol

| P (MPa) | 0.09129($MP_a$) | 0.101325($MP_a$) | 0.10245($MP_a$) |
|---|---|---|---|
| h (j/mol) | −3702.1/2198.3 | $h_s/h_b$ | −3,645.9/2221.2 |
| s (j/mol · K) | 85.624/163.09 | $s_s/s_b$ | 86.334/162.34 |

-continued

| v (mol/dm³) | 30.357 | $v_s$ | 30.200 |
|---|---|---|---|
| T (K) | 78 | T | 78.91 |

$$\frac{0.101325 - 0.09129}{0.10245 - 0.09139} = \frac{hs + 3{,}702.1}{-3{,}645.9 + 3{,}702.1} \longrightarrow h_s$$
$$= -3651.11 \text{ j/mol}$$
$$\sim = \frac{Ss - 85.624}{86.334 - 85.624} \longrightarrow s_s = 86.268 \text{ j/mol}\cdot\text{K}$$
$$\sim = \frac{Vs - 30.357}{30.200 - 30.357} \longrightarrow v_s = 30.21455 \text{ mol/l}$$
$$\sim = \frac{T - 78}{79 - 78} \longrightarrow T = 78.91 \text{ K}$$
$$\sim = \frac{hb - 2198.3}{2221.2 - 2198.3} \longrightarrow h_b = 2{,}219.1 \text{ j/mol}$$
$$\sim = \frac{Sb - 163.09}{162.34 - 163.09} \longrightarrow s_b = 162.41 \text{ j/mol}$$

$P_1$=10.0 $MP_a$, $h_1$=289.446 $k_j/k_g$
$T_1$=308K, $s_1$=159.752j/mol·K

| T | 300 | 308 | 310 |
|---|---|---|---|
| h | 8,114.2 | $h_1$ | 8,448.9 |
| s | 158.88 | $s_1$ | 159.9 |

$$\frac{308 - 300}{310 - 300} = \frac{h1 - 8{,}114.2}{8{,}448.9 - 8{,}114.2} \longrightarrow h_1 = 8{,}381.96 \text{ j/mol}$$
$$\sim = \frac{S1 - 158.88}{159.97 - 158.88} \longrightarrow s_1 = 159.752 \text{ j/mol}\cdot\text{K}$$

$P_2$=3.72284$MP_a$, $h_2$=211.815$k_j/k_g$
$S_1=S_2$=159.752 j/mol·K
P=2.0 $MP_a$

| s | 159.58 | 159.752 | 160.42 |
|---|---|---|---|
| h | 5,187.6 | $h_{2.0}$ | 5,348.6 |

$$\frac{159.752 - 159.58}{160.42 - 159.58} = \frac{h2.0 - 5{,}187.6}{5{,}348.6 - 5{,}187.6} \longrightarrow h_{2.0} = 5{,}220.57 \text{ j/mol}$$

| s | 159.66 | 159.752 | 160.94 |
|---|---|---|---|
| h | 6,787.4 | $h_{5.0}$ | 7,114.6 |

$$\frac{159.752 - 159.66}{160.94 - 159.66} = \frac{h5.0 - 6{,}787.4}{7{,}114.6 - 6{,}787.4} \longrightarrow h_{5.0} = 6{,}810.92 \text{ j/mol}$$

| P | 2.0 | 3.72289 | 5.0 |
|---|---|---|---|
| H | 5,220.57 | $h_2$ | 6,810.92 |

$$\frac{3.72284-2.0}{5.0-2.0}=\frac{h2-5{,}220.57}{6{,}810.92-5{,}220.57}\longrightarrow h_2=6{,}133.876\ \text{j/mol}$$

$P_3$=2,87207 $MP_a$, $h_3$=196.241 $k_j/k_g$
$s_3=s_1$=159.752j/mol·K
P=2 MPa

| | | | |
|---|---|---|---|
| s | 159.58 | 159.752 | 160.42 |
| h | 5487.6 | $h_{2.0}$ | 5,348.6 |

$$\frac{159.752-159.58}{160.42-159.58}=\frac{h2.0-5{,}187.6}{5{,}348.6-5{,}187.6}\longrightarrow h_{2.0}=5{,}220.57\ \text{j/mol}$$

P=5.0 $MP_a$

| | | | |
|---|---|---|---|
| s | 159.66 | 159.752 | 160.94 |
| h | 6,787.4 | $h_{5.0}$ | 7,114.6 |

$$\frac{159.752-159.66}{160.94-159.66}=\frac{h5.0-6{,}787.4}{7{,}114.6-6{,}787.4}\longrightarrow h_{5.0}=6{,}810.92\ \text{j/mol}$$

| | | | |
|---|---|---|---|
| p | 2.0 | 2.87207 | 5.0 |
| h | 5,220.57 | $h_3$ | 6,810.92 |

$$\frac{2.87207-2.0}{5.0-2.0}=\frac{h3-5{,}220.57}{6{,}810.92-5{,}220.57}\longrightarrow h_3=5{,}682.87\ \text{j/mol}$$

$P_4$=1.04961 $MP_a$ $h_4$=149.421 $k_j/h_g$
$s_4=s_1$=159.752 j/mol·K

| | | | |
|---|---|---|---|
| s | 159.62 | 159.752 | 160.63 |
| h | 4,259.6 | $h_{1.0}$ | 4,418.16 |

$$\frac{159.752-159.62}{160.63-159.62}=\frac{h1.0-4{,}259.6}{4{,}418.16-4{,}259.6}\longrightarrow h_{1.0}=4{,}280.38\ \text{j/mol}$$

P=2.0 $MP_a$

| | | | |
|---|---|---|---|
| s | 159.58 | 159.752 | 160.42 |
| h | 5,187.6 | $h_{2.0}$ | 5,348.6 |

$$\frac{159.752-159.58}{160.42-159.58}=\frac{h2.0-5{,}187.6}{5{,}348.6-5{,}187.6}\longrightarrow h_{2.0}=5{,}220.57\ \text{j/mol}$$

| | | | |
|---|---|---|---|
| p | 1.0 | 1.04961 | 2.0 |
| h | 4,280.38 | $h_4$ | 5,220.57 |

$$\frac{1.04961-1.0}{2.0-1.0}=\frac{h4-4{,}280.38}{5{,}220.57-4{,}280.38}\longrightarrow h_4=4{,}327.02\ \text{j/mol}$$

$P_5$=1,04961 $MP_a$ $h_5$=306.352 $k_j/k_g$
$T_5$=308 K $s_5$=180.121 j/mol·K

| | | | |
|---|---|---|---|
| T | 300 | 308 | 310 |
| h | 8,638.1 | $h_{1.0}$ | 8,933.6 |
| s | 179.64 | $s_{1.0}$ | 180.61 |

$$\frac{308-300}{310-300}=\frac{h1.0-8{,}638.1}{8{,}933.6-8{,}638.1}\longrightarrow h_{1.0}$$
$$=8{,}874.5\ \text{j/mol}$$
$$\sim=\frac{s1.0-179.64}{180.61-179.64}\longrightarrow s_{1.0}$$
$$=180.416\ \text{j/mol.K}$$

P=2.0 $MP_a$

| | | | |
|---|---|---|---|
| T | 300 | 308 | 310 |
| h | 8,574.3 | $h_{2.0}$ | 8,874.3 |
| s | 173.68 | $s_{2.0}$ | 174.67 |

$$\frac{308-300}{310-300}=\frac{h2.0-8{,}574.3}{8{,}874.3-8{,}574.3}\longrightarrow h_{2.0}$$
$$=8{,}814.3\ \text{j/mol}$$
$$\sim=\frac{s2.0-173.68}{174.7-173.68}\longrightarrow s_{2.0}$$
$$=174.472\ \text{j/mol.K}$$

| | | | |
|---|---|---|---|
| p | 1.0 | 1.04961 | 2.0 |
| h | 8,874.5 | $h_5$ | 8,814.3 |
| s | 180.416 | $s_5$ | 174.472 |

$$\frac{1.04961-1.0}{2.0-1.0}=\frac{h5-8{,}874.5}{8{,}814.3-8{,}874.5}\longrightarrow h_5$$
$$=8{,}871.51\ \text{j/mol}$$
$$\sim=\frac{s5-180.416}{174.472-180.416}\longrightarrow s_5$$
$$=180.121\ \text{j/mol.K}$$

$P_6$=0.101325 $MP_a$ $h_6$=157.217 $k_j/k_g$
$s_6=s_5$=180.120 j/mol·K $T_6$=157.88 K
$s_6=s_5+x(s_b-s_s)$ 180,121=86.268+x(162,41−86,268)

180,121−86.268=76.142x x=1.232 (at the superheated vapour region)

| s | 179.59 | 180.121 | 180.51 |
|---|---|---|---|
| h | 4,468.3 | $h_6$ | 4,614.7 |
| T | 155 | $T_6$ | 160 |

$$\frac{180.121-179.59}{180.51-179.59}=\frac{h6-4{,}468.3}{4{,}614.7-4{,}468.3}\longrightarrow h_6$$

$$=4{,}552.798\ \text{j/mol}$$

$$\sim=\frac{T6-155}{160-155}\longrightarrow T_6$$

$$=157.88\ \text{K}$$

$P_7$=0.101325 MPa $v_7$=30.21455 mol/l→$v_7$=0.00114289 $m^3/k_g$ $h_7$=−3651.11 j/mol→$h_7$=−126.080 $k_j/k_g$ $-W_{Pa}=v_7(P_8-P_7)\rightarrow -W_{Pa}=0.00114289\ (1049.61-101.325)=1.084\ k_j/k_g$ $-W_{Pa}$=1.084 $k_j/k_g$ $-W_{Pa}=h_8-h_7\rightarrow 1.084=h_8+126.080\Theta h_8=-124.996\ k_j/k_g$ $P_9$=1.04961 $MP_a$ $v_9$=25.058 mol/l→$v_9$=0.00137809 $m^3/k_g$ $h_9$=−1,967.8j/mol→$h_9$=−67,952 $k_j/k_g$ $-W_{Pb}=v_9(P_{10}-P_9)\rightarrow -W_{Pb}=0.001378085\ (2872.07-1,049.61)$ $-W_{Pb}$=2.511 $k_j/k_g$ $-W_{Pv}=h_{10}-h_9\rightarrow 2.511=h_{10}+67.952\rightarrow h_{10}=-65.411\ k_j/k_g$ $P_{11}$=2.87207 $MP_a$ $v_{11}$=19.278 mol/l→$v_{11}$=0.00179127 $m^3/k_g$ $h_{11}$=−475.47 j/mol→$h_{11}$=−16.419 $k_j/k_g$ $-W_{Pc}=v_{11}(P_{12}-P_{11})\rightarrow -W_{Pc}=0.00179127(3722.84-2872.07)$ $-W_{Pc}$=1.524 $k_j/k_g$ $-W_{Pc}=h_{12}-h_{11}\rightarrow 1.524=h_{12}+16.419\rightarrow h_{12}=-14.899\ k_j/k_g$ $P_{13}$=3.72284 $MP_a$ $v_{13}$=14.198 mol/l→$v_{13}$=0.00243218 $m^3/k_g$ $h_{13}$=478.83 j/mol→$h_{13}$=16.535 $k_j/k_g$ $-W_{Pd}=v_{13}(P_{14}-P_{13})\rightarrow -W_{Pd}=0.00243218(10{,}000-3{,}722.84)$ $-W_{Pd}$=15.267 $k_j/k_g$ $-W_{Pd}=h_{14}-h_{13}\rightarrow 15.267=h_{14}-16.535\rightarrow h_{14}=31.802\ k_j/k_g$ Calculations regarding Enthalpy points, pump works and condensed masses;

| |
|---|
| $h_1$ = 289.446 $k_j/k_g$ |
| $h_2$ = 211.815 $k_j/k_g$ |
| $h_3$ = 196.24 $k_j/k_g$ |
| $h_4$ = 149.421 $k_j/k_g$ |
| $h_5$ = 306.352 $k_j/k_g$ |
| $h_6$ = 157.217 $k_j/k_g$ |
| $h_7$ = −126.080 $k_j/k_g$ |
| $h_8$ = −124.996 $k_j/k_g$ |
| $h_9$ = −67.952 $k_j/k_g$ |
| $h_{10}$ = −65.441 $k_j/k_g$ |
| $h_{11}$ = −16.419 $k_j/k_g$ |
| $h_{12}$ = −14.895 $k_j/k_g$ |
| $h_{13}$ = 16.535 $k_j/k_g$ |
| $h_{14}$ = 31.802 $k_j/k_g$ |

$m_{1=0.139}$ $k_g$, $m_2$=0.161 $k_g$, $m_3$=0.145 $k_g$, m=0,445 $k_g$ $-W_{Pa}$=1.084 $k_j/k_g$, $-W_{Pb}$=2.511 $k_j/k_g$, $-W_{Pc}$=1.524 $k_j/k_g$, $-W_{Pd}$=15.267 $k_j/k_g$ $m_1(h_2-h_{13})=(1-m_1)(h_{13}-h_{12})\rightarrow m_1(211.815-16.353)=(1-m_1)(16.553+14.895)$ $195.28m_1=31.43-31.43m_1\rightarrow 195.28m_1+31.43m_1=31.43$ $m_1$=0.139 $k_g$ $m_2(h_3-h_1)=(1-m_1-m_2)(h_{11}-h_{10})$ $m_2(196{,}24+16.419)=(1-0.39-m_2)(-16.419+65.441)$ $212.66m_2+49.022m_2=42.208\rightarrow m_2=0.161\ k_g$ $m_3(h_4-h_9)=(1-m_1-m_2-m_3)(h_9-h_8)$ $m_3(149.421+67.952)=(1-0.139-0.161-m_3)(-67.952+124.996)$ $217.373m_3=39.931-57.044m3$ $217.373m_3+57.044m_1=39.931\rightarrow m3=0.145\ k_g$ $m=m_1+m_2+m_3=0.139+0.161+0.0145=0.445\ k_g$ $W_T=h_1-h_2+(1-m_1)(h_2-h_3)+(1-m_1-m_2)(h_3-h_4)+(1-m)(h_5-h_6)$ $W_T=289.446-211.815+(1-0.139)(211.815-196.24)+(1-0.139-0.161)\ .\ .\ .=(196.24-149.421)+(1-0.446)(306.352-157.217=$ $W_T=77.631+13.410+32.773+82.770=206.584$ $W_T=206.584\ k_j/k_g$ $W_{net}=W_T-(1-m)W_{Pa}-(1-m+m_3)W_{Pb}-(1-m+m_2+m_3)W_{Pc}-W_{Pd}$ $W_{net}=206.584-(1-0.445)1.084-(1-0{,}445+0.145)2.511-(1-0.445+0.161+0.145)\ .\ .\ .\times 1.524-15.267$ $W_{net}=206.584-0.602-1.758-1.312-15.267$ $W_{net}=187.645\ k_j/k_g$ Thermal Efficiency;

$q=h_1-h_{14}+(1-m)(h_5-h_4)$ $q=289.446-31.802+(1-0.445)(306.352-149.421)$ $q=257.644+87.097=344{,}741\ k_j/k_g$, q=344.741 kj/kg $\eta_{thermal}=W_{net}/q=187.645/344.741=\%54.43$, $\eta_{thermal}=\%54.43$ Capacity of 1 $k_g$ fluid;

$k=W_{net}/(1-m)=187.645/(1-0.445)=338.099$ kj/kg, k=338.099 kj/kg

Capacity for M=400 kg reservoir;

$$K=\frac{k\cdot M}{3600}=((338.099)(400))/3600=37.57\ \text{kWh},\ K=37.57\ \text{kWh}$$

Irreversibility effect and Real Cycle;

In order to obtain the real cycle of steam engines, it is necessary to take into account the required difference in order to overcome frictional losses occurring in various amounts and heat losses and to provide heat transfer in the heaters.

Due to isoentropical compression and expansion division processes that are a crucial part of the compression process and the expansion process in a turbine, differences occur in thermodynamic features. It has been accepted that heat flow to the environment from the pump and the turbine is accepted to be zero. Said losses are as follows when pump and turbine indicated yields are taken into consideration;

Has been accepted as, $\eta_{it}$=0.90, $\eta_{ip}$=0.80.

$W_{it}=W_T,\eta_{it}=206.584.090=185.926\ k_j/k_g$, $W_{net}$=185.926 $k_j/k_g$ $-W_{ip}=W_p/\eta_{ip}=(W_T-W_{net})/\eta_{ip}=(206-584-187.645)/0.8$ $-W_{ip}$=23.674 $k_j/k_g$ $W_{net,i}=W_{it}-W_{ip}=185.926-23.674=162.252\ k_j/k_g$ $W_{net,i}$=162.252 $k_j/k_g$ $$\eta_{i,thermal} = \frac{Wit - Wip}{h1 - h14 + (1-m)(h5 - h4)} \longrightarrow h_{14} = h_{13} + \left((h_{14} - h_{13})/\eta ip\right) =$$

$$16.535 + ((31.802 - 16.535))/(0.8) \longrightarrow h_{14} = 35.619 \text{ kj/kg}$$

$$\eta_{i,net} = (185.962 - 23.674)/\left((289.446 - 35.619) + (1 - 0.520)(306.352 - 149.421)\right)$$

$$\eta_{i,net} = \%49.42$$

Yield provided by 1 kg liquid air: $k = W_{net}/1 - m = 162.252/1 - 0.445$ $k = 292.346\ k_j/k_g$ Capacity of M=400 kg reservoir

What is claimed is:

1. A power generating machine system, comprising:

a first heater located in the system, a second heater connected to the first heater, a third heater connected to the second heater, a fourth heater connected to the third heater, a first turbine directly connected to the first heater, the second heater, the third heater, and the fourth heater, a second turbine directly connected to the fourth heater, a reservoir, a first pump located between the first heater and the reservoir, and the first pump is configured to draw liquid nitrogen or liquid air in the reservoir at atmospheric pressure, pump up a pressure of the liquid obtained from the reservoir, and spray liquid steam onto the first heater, a second pump located between the first heater and the second heater, a third pump located between the second heater and the third heater, and a fourth pump located between the third heater and the fourth heater.

2. The power generating machine system according to claim 1, wherein the reservoir is connected to the first heater.

3. The power generating machine system according to claim 1, comprising a valve located between the first heater and the second heater, between the second heater and the third heater and between the third heater and the fourth heater.

4. The power generating machine system according to claim 1, comprising a first turbine opening of the first turbine enabling a connection between the first turbine and the first heater.

5. The power generating machine system according to claim 1, comprising a second turbine opening of the first turbine enabling a connection between the first turbine and the second heater.

6. The power generating machine system according to claim 1, comprising a third turbine opening of the first turbine enabling a connection between the first turbine and the third heater.

7. The power generating machine system according to claim 1, comprising an exhaust opening located on the second turbine.

8. The power generating machine system according to claim 2, comprising a valve located between the first heater and the second heater, between the second heater and the third heater and between the third heater and the fourth heater.

9. The power generating machine system according to claim 2, comprising a first turbine opening of the first turbine enabling a connection between the first turbine and the first heater.

10. The power generating machine system according to claim 3, comprising a first turbine opening of the first turbine enabling a connection between the first turbine and the first heater.

11. The power generating machine system according to claim 2, comprising a second turbine opening of the first turbine enabling a connection between the first turbine and the second heater.

12. The power generating machine system according to claim 3, comprising a second turbine opening of the first turbine enabling a connection between the first turbine and the second heater.

13. The power generating machine system according to claim 4, comprising a second turbine opening of the first turbine enabling a connection between the first turbine and the second heater.

14. The power generating machine system according to claim 2, comprising a third turbine opening of the first turbine enabling a connection between the first turbine and the third heater.

15. The power generating machine system according to claim 3, comprising a third turbine opening of the first turbine enabling a connection between the first turbine and the third heater.

16. The power generating machine system according to claim 4, comprising a third turbine opening of the first turbine enabling a connection between the first turbine and the third heater.

17. The power generating machine system according to claim 5, comprising a third turbine opening of the first turbine enabling a connection between the first turbine and the third heater.

18. The power generating machine system according to claim 2, comprising an exhaust opening located on the second turbine.

19. The power generating machine system according to claim 3, comprising an exhaust opening located on the second turbine.

20. The power generating machine system according to claim 4, comprising an exhaust opening located on the second turbine.

* * * * *